United States Patent [19]

van Zijverden

[11] Patent Number: 4,842,166

[45] Date of Patent: Jun. 27, 1989

[54] DISPENSER FOR PRODUCING AND DISPENSING BEVERAGES MIXED OF FRUIT SYRUP OR CONCENTRATE AND WATER

[75] Inventor: Willem van Zijverden, Lübeck, Fed. Rep. of Germany

[73] Assignee: Dagma Deutsche Automaten- und Getrankemaschinen GmbH & Co. KG, Rheinfeld, Fed. Rep. of Germany

[21] Appl. No.: 20,378

[22] Filed: Mar. 2, 1987

[30] Foreign Application Priority Data

Mar. 7, 1986 [DE] Fed. Rep. of Germany ..... 3607623

[51] Int. Cl.[4] ..... B67D 5/56

[52] U.S. Cl. ..... 222/129.2; 137/888; 137/895; 222/183; 222/145; 239/318; 285/223

[58] Field of Search ..... 222/57, 129.1, 129.2, 222/144.5, 145, 183, 134; 239/318, 570, 571; 137/605-607, 888, 889, 893, 895, 892; 417/182, 183, 184; 285/223, 231

[56] References Cited

U.S. PATENT DOCUMENTS

| | | | |
|---|---|---|---|
| 2,754,999 | 7/1956 | Bauerlein | 222/129.2 |
| 2,785,830 | 3/1957 | Bauerlein | 222/57 |
| 3,115,352 | 12/1963 | Heerlein | 285/223 X |
| 3,202,363 | 8/1965 | Kautz et al. | 239/570 X |
| 3,578,219 | 5/1971 | Berry | 222/464 X |
| 4,286,636 | 9/1981 | Credle | 222/501 X |

FOREIGN PATENT DOCUMENTS

| | | | |
|---|---|---|---|
| 3234957A1 | 3/1984 | Fed. Rep. of Germany . | |
| 722951 | 2/1955 | United Kingdom | 239/571 |

*Primary Examiner*—Kevin P. Shaver

*Attorney, Agent, or Firm*—Herbert Dubno

[57] ABSTRACT

A dispenser for producing and dispensing beverages mixed of fruit syrup or concentrate and water which has associated therewith a water jet injection device. The fruit syrup or the concentrate is provided in a refillable and/or removable and insertible storage vessel provided with a sliding bushing or a clamping device with the aid of which the water jet injection device can be brought into sealing communication with the storage vessel, with the necessary connections with the interior of the storage vessel and a pressurized water conduit, respectively, being simultaneously and automatically guaranteed in response to the movement. The arrangement is such that the water jet injection device can be brought into sealing connection with the storage vessel by a simple movement and the storage vessel and the water jet injection device can be placed in an accommodation piece of the dispenser housing by a movement which is as simple as the first one and extends in the same direction, with a connection to a water connection coupling supported in the dispenser housing in elastically floating fashion being simultaneously established as well.

9 Claims, 5 Drawing Sheets

51
68
70
66
61
56
55
50
69
64
71
65
67
75
52
51
76
55
62

53
61
65
60
63
50
79

58
52
54
51
55
57
56
53

DISPENSER FOR PRODUCING AND DISPENSING BEVERAGES MIXED OF FRUIT SYRUP OR CONCENTRATE AND WATER

FIELD OF THE INVENTION

The present invention relates to a dispenser for producing and dispensing beverages mixed from fruit syrup or concentrate and water including a water jet injection device. The dispenser is also suitable for dispensing mixed cocoa beverages or soups or the like of a paste-like or mushy mass and water, or other mixtures.

BACKGROUND OF THE INVENTION

A water jet injection device suitable for use in a dispenser is shown, for example, in German Offenlegungsschrift No. 32 34 957.2. This device is provided with connections for conduits which, on the one hand, are connected to the storage vessel containing either the fruit syrup or the concentrate and, on the other hand, communicate with a pressurized source of fresh water. The prior known arrangement is difficult and time-consuming to manufacture and assemble and occupies a lot of space. Moreover, the comparatively long connecting conduits are not only disturbing since only little space is available in a dispenser of such type, and have also proved to be complicated to clean or replace the conduits when one wishes to change from one mixing product to another one.

OBJECT OF THE INVENTION

It is an object of the present invention to improve a dispenser having the features of the generic clause of claim 1 so as to avoid the aforementioned drawbacks and ensure a less difficult, time-consuming and expensive manufacture and, above all, a generally less complicated assembly and a simple and fast replacement of individual parts, with the space occupied by the arrangement being also considerably reduced. A fast and comfortable cleaning of the individual parts should also be ensured.

SUMMARY OF THE INVENTION

This object is attained in a dispenser for producing and dispensing mixtures of water and another material, in particular beverages mixed of fruit syrup and cencentrate and water, comprising a dispenser housing, a storage vessel, for syrup or concentrate, which is insertible into the dispenser housing, and a water jet injection device which includes an elongated injector housing having a mixing chamber into which a water jet pipe adapted to be connected with a water feed conduit extends from one side and from which a nozzle portion for discharging the mixture into an outlet section extends toward the other side, the injector housing being provided at the height of the mixing chamber with a lateral inlet for the syrup.

According to the invention the injector housing and the storage vessel are either connected through a fixed connection or are adapted to be interconnected in direct and easily releasable manner by a plug or clamping connection.

A water feed portion is adapted to be connected with the water jet pipe and the arrangement is so designed that when the storage vessel plus the injector housing and the water feed portion are placed in the dispenser housing the free end of the water feed portion necessarily sealingly engages a water connection plug coupling stationarily mounted on the dispenser housing and particularly provided with a floatingly supported sealing element.

A particular mounting arrangement for the water jet injection device can be dispensed with in the case of the present construction, since a simple plug or clamping connection is employed for holding the water jet injection device which in the assembled state, on the one hand, establishes a direct connection between the interior of the storage vessel and the interior of the mixing chamber of the water jet injection device and, on the other hand, also establishes the connection of the water jet injection device with the source of fresh water.

It is particularly advantageous when a bushing is permanently attached to the bottom of the storage vessel or reservoir, i.e. when the bushing is integrally formed therewith. In this case, the water jet injection device is directly supported in a reliable manner by a member integrally formed with the storage vessel, with this member simultaneously establishing the connection with the fresh water conduit. A particularly simple assembly results when the injector housing and the bushing form a sealed plug connection so that, for safely accommodating the water jet injection device within the dispenser and for establishing the direct connection between the interior of the storage vessel and the mixing chamber of the water jet injection device, a single, simple plug-in sliding movement is required.

Advantageously the water feed portion is associated with the injector housing. When the injector housing is installed, a plug connection between the water feed portion of the injector housing, on the one hand, and the water connection end of the bushing can be established at the same time so that a single movement not only safely positions the injection device within the dispenser but all of the connections the water jet injection device requires are simultaneously established as well.

With regard to manufacture, the arrangement also has essential advantages because the water jet injection device, in completely pre-assembled fashion and by a single movement only, can be brought into its operating position as well as into readiness for working. Consequently, also maintenance and repair or replacing services are facilitated in the injection device.

By reason of the connection provided between the storage vessel and the injection device, the storage vessel together with the water jet injection device either can be removed from or re-inserted into the dispenser housing as a unit, and as a matter of fact, again by means of a simple movement substantially in the same sense as the plug-in sliding movement for establishing the water connection for the injection device. When the product is changed, the parts consequently can be replaced without it being necessary to carefully clean the storage vessel and/or the water jet injection device, since together with the new storage vessel for the other product another water jet injection device associated with the storage vessel can be inserted into the dispenser housing at the same time. It will be advantageous to then design the water connection plug coupling so that the water connection plug coupling includes a coupling bushing placed in the dispenser housing in a universally elastically floating and sealing fashion.

The coupling housing can have a centering surface for the insertion end of the water feed portion and behind the centering surface is provided with a slide seal cooperating with the insertion end.

The centering surface is provided in the form of an annular member which is easily detachable from the coupling bushing from the side of accommodation for the storage vessel and after the annular member has been removed, the slide seal is freely accessible.

As the storage vessel is inserted into the dispenser housing, the plug coupling establishes the sealed connection between the connection end of the bushing and the water connection coupling in the dispenser housing. The arrangement is such that in a considerable range of tolerance any errors in alignment between the connection end of the bushing and the water connection coupling in the dispenser housing automatically are compensated and a uniform loading of the associated slide seal as well as its simple replacement are ensured. The plug coupling can further automatically block water flow when the injector housing is not connected.

BRIEF DESCRIPTION OF THE DRAWING

The above and other objects, features and advantages of the present invention will become more readily apparent from the following description, reference being made to the accompanying drawing in which.

Specific Description

Figure 4:
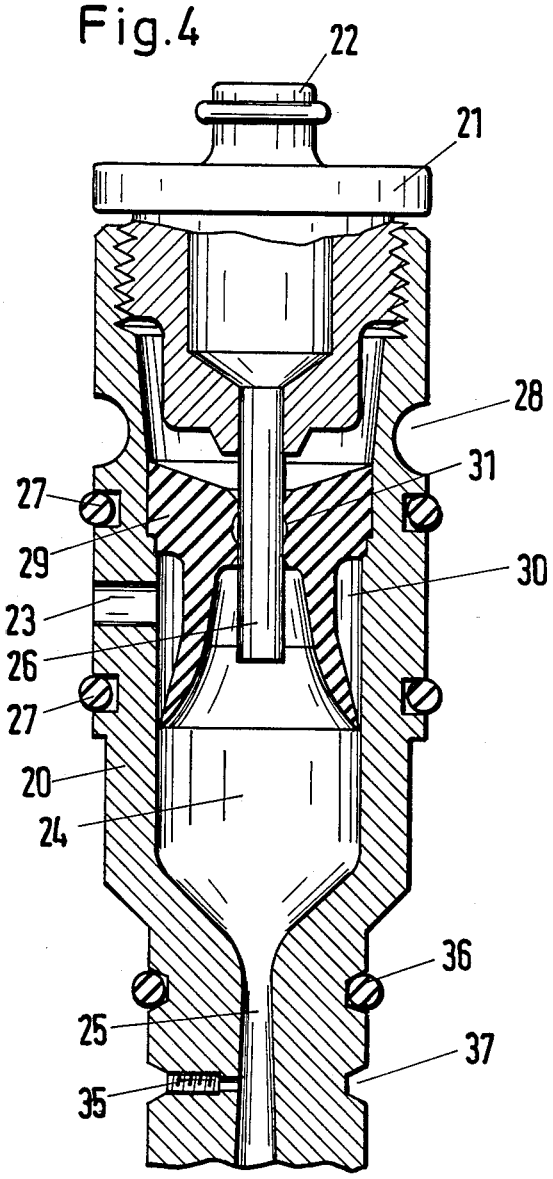
FIG. 4 is an enlarged and vertical sectional view of the water jet injection device adapted to be inserted as a pre-assembled unit into the bushing of the storage vessel according to FIG. 3.

The water jet injection device shown in FIG. 4 comprises a sleeve-type injector housing 20 formed of two pieces. A plug-type member 21 can be screwed into the upper end of the bushing-shaped portion, plug-type member 21 centrally supporting water jet pipe 26 which extends through a packing-type sealing element 29 and thereby forms a slide seal. Sealing element 29 seals the rearward area of injector housing 20 against the forward mixing chamber 24 from which a nozzle portion 25 forwardly extends toward the discharging end. In the nozzle portion 25 there is provided a radial air intake opening 35 which, if need arises, can be closed by placing annular seal 36 in groove 37.

With its lower non-return valve-type seal lip, sealing element 29 seals an annular dispensing chamber 30 into which a radial hole 23 opens. On either side of hole 23 the injector housing 20 has two O-shaped annular seals 27. An annular groove 28 is provided upstream of the upper annular seal 27. Furthermore, the plug-type member 21 includes a central plug connection piece 22 having an annular seal whose function will further down be explained in more detail.

Figures 1, 2, 3:
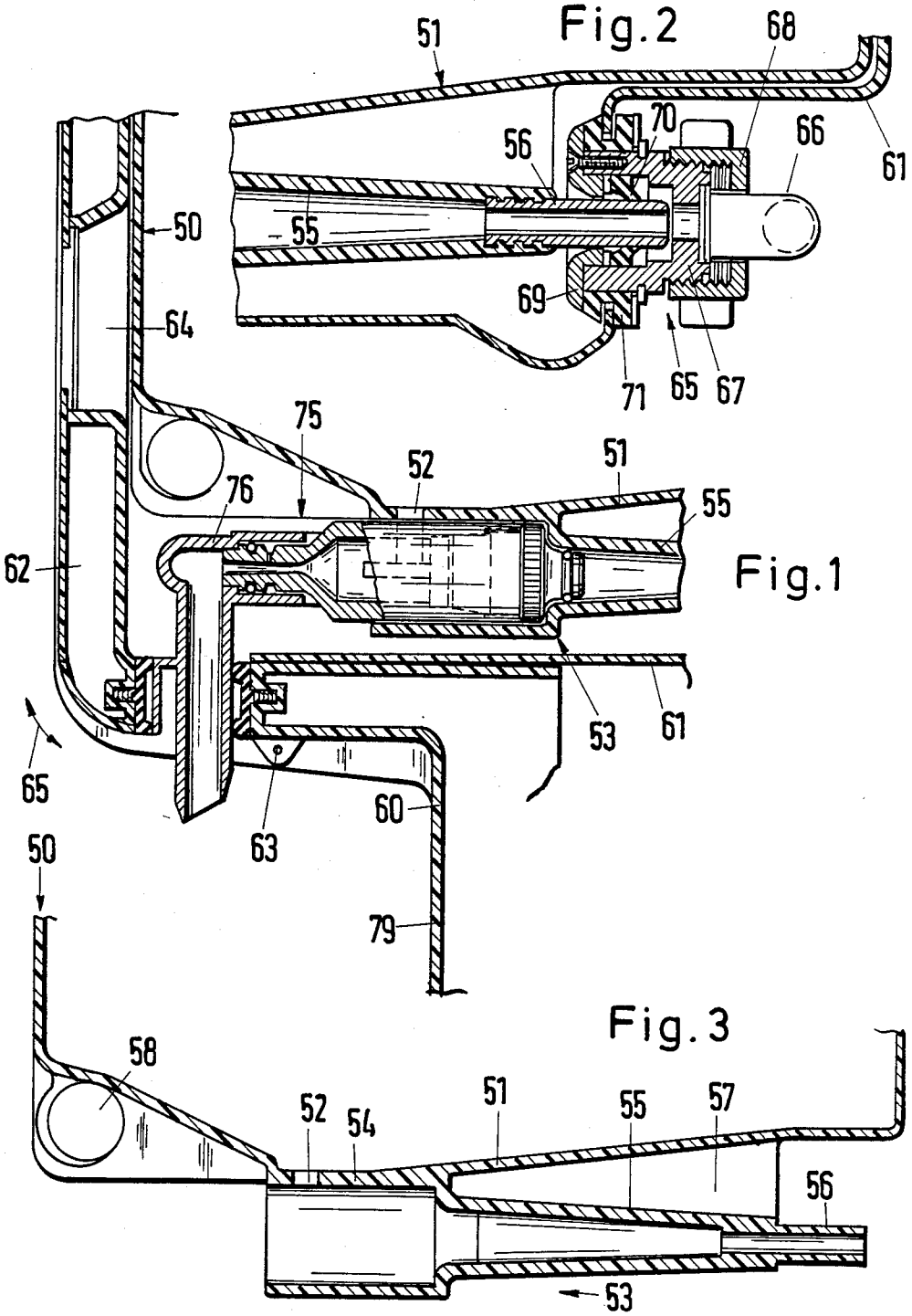
FIG. 1 is a vertical sectional view of a detail of the dispenser as well as of a part of the storage vessel and the water jet injection device.
FIG. 2 is a view, similar to that of FIG. 1, of the part of the arrangement next to FIG. 1 on the right hand side.
FIG. 3 is a vertical sectional view of the bottom portion of the storage vessel including the associated bushing, the storage vessel having been removed and the water jet injection device being also not shown.

The water jet injection device shown in FIG. 4 can be inserted into the bushing 53 open toward the left hand side in FIG. 1 by a simple, horizontal sliding movement until the radial hole 23 in the injector housing 20 is in alignment with the hole 52 on the bottom 51 of a storage vessel 50 for the fruit syrup or the concentrate preferably made of transparent synthetic material. In this position, the injector housing 20 can be locked in the bushing 53 by moving a locking bar, not shown, into the bushing 53 in such a way that said locking bar partly engages the annular groove 28 provided in the injector housing 20. In the assembled state, the annular seals serve to hermetically seal the arrangement on both sides of the radial holes 23 and 52 which are in alignment with one another. Mixing chamber 24 and annular dispensing chamber 30 are thus brought into a direct and the shortest possible communication with the interior of the storage vessel 50.

It will be expedient to form the bushing 52 integrally with the bottom of the storage vessel 50 and, therefore, allow the two parts to be formed in one single piece. The rearward end of the bushing 53 is provided with an elongated tubular member 55 which is of generally cylindrical shape in its first section of its left-hand end. This section sealingly cooperates with the plug connection end piece 22 of the injection device, as shown in FIG. 1, when the injection device is inserted in the bushing 53.

Member 55 further extends in tapered fashion and is formed at the right-hand, opposite end thereof with a connection piece 56 adapted to be sealingly inserted into a water connection coupling 65, connection piece 56 being inserted into coupling 65 in the same direction as injector housing 20 is inserted into the bushing 53.

To compensate for errors in alignment, water connection coupling 65 is attached to a wall 61 of the dispenser housing in an elastically floating fashion. For this purpose there is provided a resilient ring member 71 embracing the edge of an opening in the dispenser housing 61 and encircling a coupling bushing 67 which at the rearward end thereof is sealingly screwed to the water conduit 66 through a screw cap 68. On its outer periphery, the coupling bushing is provided with a shoulder portion for the resilient ring member 71 which is tensioned under the action of a forward guide ring 69 and pressed against said shoulder portion, the guide ring being in screw threaded engagement with the coupling bushing. The associated screws are accessible from the left hand side in FIG. 2, which means, from outside of the dispenser housing 61. Guide ring 69 has an oblique inlet surface for centering the connection piece 56 during insertion. Secured and covered by guide ring 69 is a slide seal 70 disposed in the interior of the coupling bushing 67 which seal is responsible for sealing the coupling members in the coupled or assembled stated. After the guide ring 69 has been released, seal 70 is easily accessible and replaceable.

The wall 61 of the dispenser housing at the same time forms an accommodation piece for the unit composed of storage vessel 50 and bushing 53 which can be inserted into said accommodation piece from the left hand side in FIGS. 1 and 2, connection piece 56 being automatically brought into sealing engagement with the water connection coupling 65.

The accommodation piece in the dispenser housing is closed by means of a cover member 62 covering the front side and part of the upper side of the accommodation piece. The cover member 62 can be pivoted at point 63 on the dispenser housing according to the double-headed arrow 65 from the closed position shown in FIG. 1 into an intermediate position in which the upper opening of the storage vessel 50 is accessible for refilling and into a completely open position, in which the storage vessel together with the bushing 53 and together with the water jet injection device 75 can be removed from the accommodation piece in the dispenser housing in a direction toward the left hand side in FIG. 1 and, if need arises, can be re-inserted into the dispenser housing or can be replaced by another combination of storage vessel and injection device. For this purpose, the connection piece 56 of the injection device can be swung about the horizontal axis of the injection device as can be readily concluded from FIG. 1 by those skilled in the art.

In FIG. 3, 54 designates the section of the bushing 53 into which the injector housing can be sealingly inserted. A stiffening rib 57 is provided between the elongated rearward portion of the bushing and the bottom 51 of the storage vessel 50. Reference numeral 58 represents a forward lower handle portion to facilitate the taking of, the insertion and the removal of the storage vessel and the associated parts.

Cover member 62 as well as the dispenser housing can be made of a heat insulating material so that the storage vessel can be cooled.

To facilitate the supervision of the liquid level in the storage vessel 50 it is advantageous to fabricate the latter from a transport synthetic material. At a corresponding height, cover member 62 is provided with a window 64 which can be associated with further additional supervising means if so desired.

Figure 5:
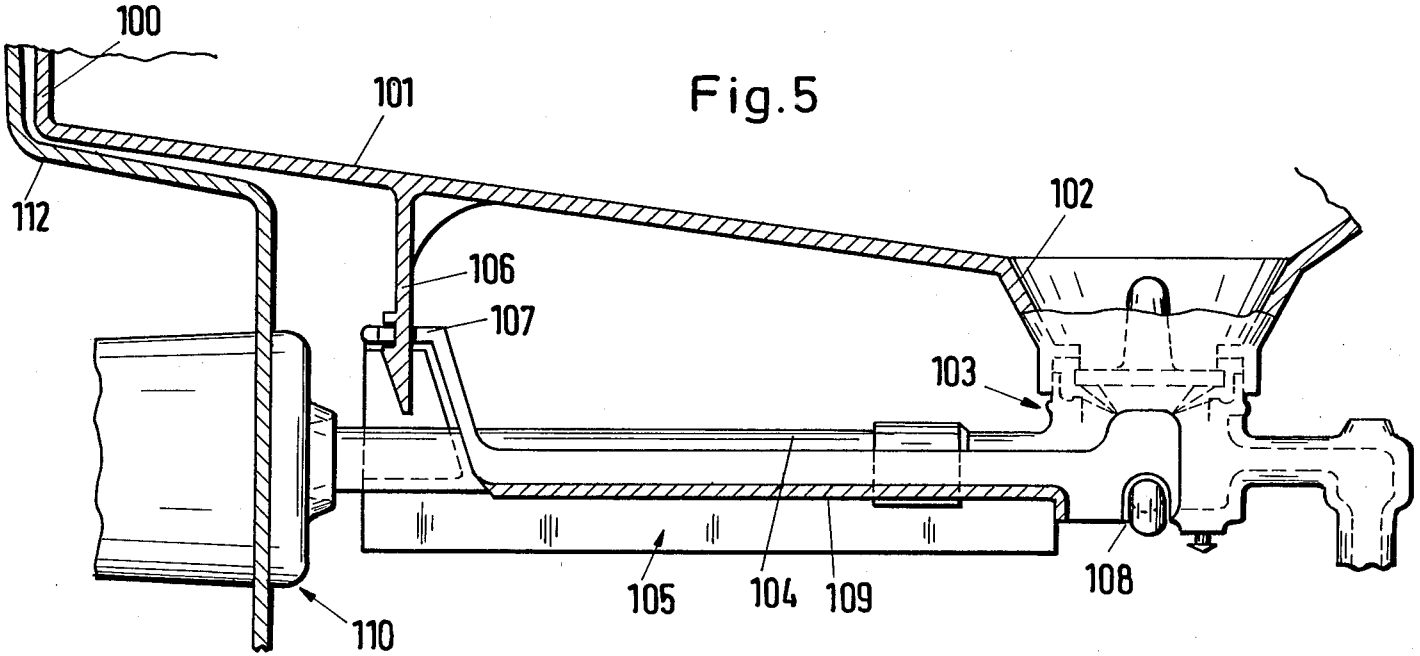
FIG. 5 is a vertical sectional view of a detail of a modified embodiment.
Figure 6:
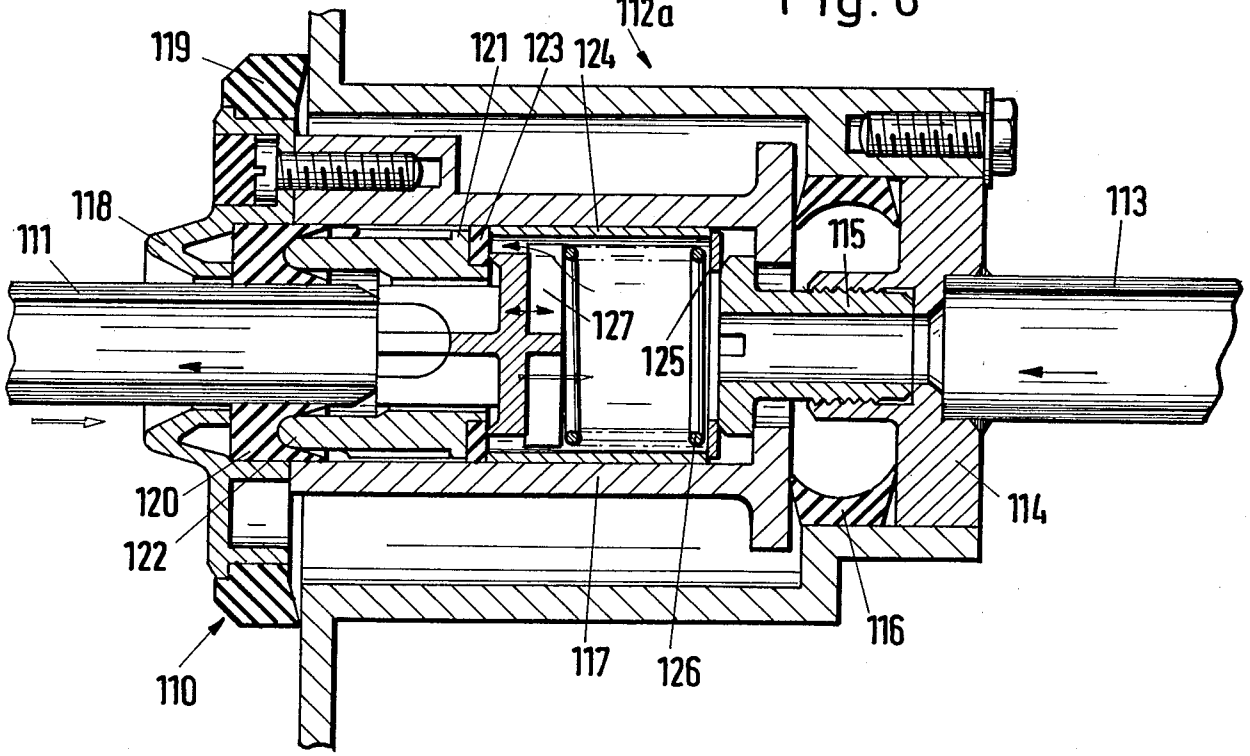
FIG. 6 is a longitudinal sectional view of a plug coupling of preferred design.
Figure 7:
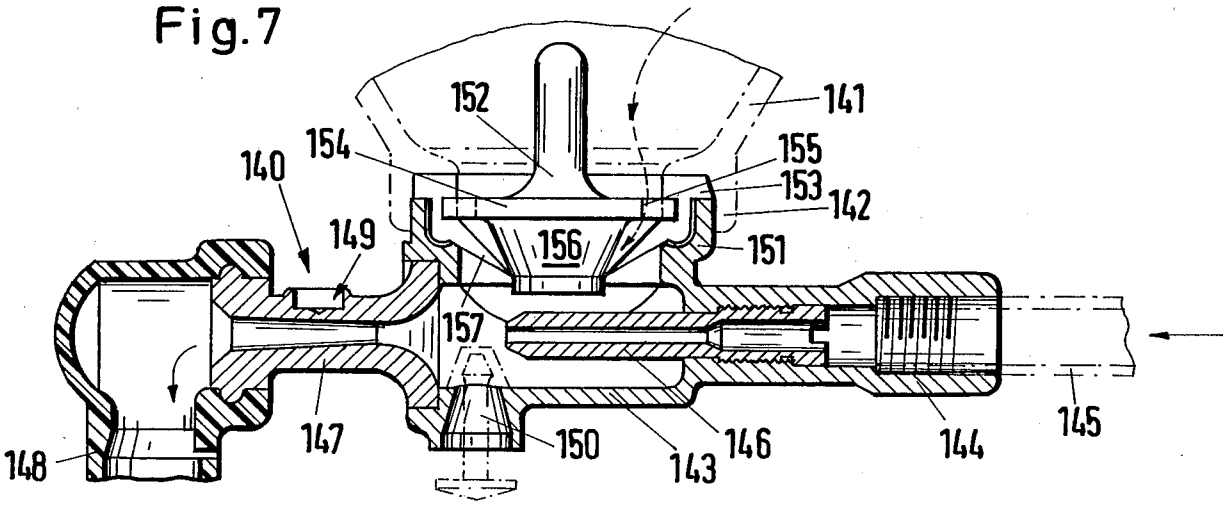
FIG. 7 is a longitudinal sectional view of the injection housing of the embodiment according to FIG. 5.

In the embodiment shown in the FIGS. 5 to 7, the bottom 101 of storage vessel 100 has a discharge opening 102 tapering downwardly. The storage vessel is adapted to be inserted into an accommodation piece of the dispenser housing 112, as has been described hereinbefore. Water jet injection device 103 can be connected to the discharge opening provided at the bottom of the vessel in a simple way and by a simple movement. A clamping means 105 can be used for this purpose which simultaneously forms the support 109 of the storage vessel and reliably and sealingly holds the injection device 103 together with water feed portion 104 connected to the injector housing at the bottom 101 of the storage vessel. For this purpose, the one end of the clamping means is adapted to snap onto a holding portion 106 of the bottom at point 107, while the other end is adapted to be tightened to the discharge opening 102 at point 108 thereby sealingly pressing the injection device 103. With its other end, water feed portion 104 projects into a water connection plug coupling 110 which is fixedly positioned in the dispenser housing 112.

In this embodiment, the injector housing 143 (FIG. 7) comprises a connection piece 151 provided on the periphery thereof and having placed therein with its central portion, an annular sealing element. The sealing element has a ring-shaped sealing disk 153 which as it is pressed sealingly engages the connecting piece 142 of the discharge opening 141 of the storage vessel. In the center section of the sealing element an insert member 152, 156 is held by means of a collar 154, said insert member having passage openings 155 for syrup or concentrate. The frustoconical lower portion 156 of the insert member is engaged in self-sealing manner by the frustoconical lip-shaped portion 157 of the sealing element. Below this section, the mixing chamber of the injector housing is located into which the water jet pipe 146 opens. The respective end of the injector housing 143 is fixedly connected to the one end 145 of the water feed portion 104 at point 144. At the other end, a nozzle or diffuser portion 147 extends from the mixing chamber, said portion 147 opening into a discharge section 148. A predetermined breaking point is provided at point 149 at which, if need arises, an air intake opening can either be drilled or produced in another manner. Reference numeral 150 designates a flapper which can be moved into the zone of action of the water jet pipe 146 to ensure by atomizing the water jet a careful cleaning of the interior of the injector housing. The structural unit 140 composed of water feed portion 104 and injector housing 143 can thus be sealingly and fixedly attached to the bottom 101 of the storage vessel with a single, simple manipulation.

When the injector housing is assembled or the overall structural unit is inserted into the dispenser housing, the other end 111 of the water feed portion is placed in the plug coupling 110 for water connection (FIG. 6). For this purpose, the dispenser housing has a bushing portion 112*a*. To the bottom of said bushing portion 112*a* the water connection 113, which is fixedly secured to the device, is fixedly attached by means of a flange 114. A holding piece 115 accessible from the left hand side in FIG. 6 can be screwed into the flange 114, said holding piece urging the inner end of a bushing 117 supported in elastically floating fashion against the seal lip 116 disposed between the flange 114 and the bottom of the bushing 117. A centering surface 118 for the end 111 of the water feed portion 104, which is also accessible from the left hand side, is in screw threaded engagement with the outwardly positioned end. The water feed portion contacts the dispenser housing 112 in elastically floating fashion through sealing element 119. A lip-shaped slide seal 120 is positioned behind the centering surface 118 which, from the left hand side, is easily accessible after the centering surface 118 has been removed. At the same time, the slide seal sealingly engages the inner surface of the bushing 117 and the outer side of end 111.

A hollow cylindrical guiding element 121 is provided in the floatingly supported bushing 117, the left end 122 of said hollow cylindrical guiding element axially sealingly contacting the slide seal 120. The other end provides a seat surface 123 for a valve element 127 movable in axial direction according to the double-headed arrow. The valve element is acted upon by a biasing spring 126 which bears against the head of the holding piece 115 through a washer 125.

The hollow cylindrical guiding element 121 at the same time is secured in position by a spacer bushing 124. The plug coupling shown in this embodiment, consequently, also fulfills a blocking function and allows water to pass only in case the end 111 of the water feed portion 104 has been properly placed in the plug coupling. The plug coupling further allows considerable errors in alignment between the water feed portion 104 and the water connection tube 113. This embodying example of the plug coupling may be also used in place of the plug coupling according to FIG. 2 in the first embodiment.

In the aforementioned embodiments, the injection device is available as pre-assembled unit and the person operating the dispenser can connect the unit with the storage vessel and, if desired, with the water feed portion in an easily releasable manner. This arrangement can then be placed in the dispenser, with the injection device being simultaneously and necessarily sealingly connected with the water connection of the dispenser.

It may be particularly advantageous, however, to provide a single-use container which comprises the storage vessel, the injector housing, the water jet pipe and the nozzle portion in the form of a structural unit which, filled with syrup or the like, is so available on the market. The manufacturer can further already integrate the water feed portion into the structural unit as well. In these cases, handling of the device is extremely simple, comfortable and safe as errors when the single-use container is installed or replaced are virtually excluded. The replacing operation further is very clean and hygienic.

I claim:

1. A dispenser for a mixture of water with another substance, comprising:

a dispenser housing formed with a compartment;

a storage vessel for said substance removably received in said compartment and formed with a downwardly opening outlet at a bottom portion of said vessel, said dispenser housing having wall means disposed so that said storage vessel can be inserted into said compartment by sliding it linearly into said dispenser housing in one direction and can be removed by sliding said storage vessel linearly in an opposite direction from said dispenser housing;

a water jet injection device coupled with said storage vessel and insertable therewith into said dispenser housing and removable with said storage vessel from said dispenser housing, said water jet injection device comprising:

an elongated mixer housing extending generally in said one direction and formed with a generally elongated mixing chamber, and a mixture-discharge nozzle extending away from one end of said mixing chamber, means including a connecting flange on said mixer housing for mechanically connecting said water jet injection device to said storage vessel and a sealing element in said flange for sealing said mixer housing to said bottom of said storage vessel with a passage on said mixer housing communicating with said outlet, a water jet tube projecting into said mixing chamber from an opposite end thereof, and a tubular water-feed member extending in said one direction from said mixer housing; and connector means on said dispenser housing for releasably receiving said tubular water-feed member, said connector means comprising:

a bushing portion formed in said dispenser housing and opening in said opposite direction, a coupling sleeve received in said bushing portion with limited axial and radial play therein, said sleeve having a mouth opening in said opposite direction at one end and a bottom at an end opposite said mouth, another sealing element between said bottom of said sleeve and said bushing portion and a sealing cover extending across said mouth for floatingly supporting said sleeve on said bushing portion with said play while sealing the interior of said sleeve against said housing, said cover being provided with means for guiding said tubular water-feed member into the interior of said sleeve and a sliding lip seal for sealing said tubular water-feed member against said sleeve whereby said tubular water-feed member automatically enters and is received in said lip seal upon insertion of said storage vessel and said water jet injection device as a unit into said dispenser housing, and means for connecting a water-supply pipe to said sleeve at said bottom thereof.

2. The dispenser defined in claim 1 wherein said sealing element in said flange bears against an edge of said storage vessel around said outlet and has a resilient annular lip forming, together with an insert in the outlet of said storing vessel, a one-way valve between said storage vessel and said mixing chamber, said lip extending into an opening in said mixer housing.

3. The dispenser defined in claim 1, further comprising a hollow threaded element engaging said bushing portion and extending centrally and axially into said bottom of said sleeve and bracing said bottom of said sleeve against said other sealing element.

4. The dispenser defined in claim 1 wherein said cover comprises a rigid guide member on a side of said cover turned toward said water jet injection device and has a rigid flange pressing an annular seal against a wall of said dispenser housing around an open end of said bushing portion for floatingly supporting said sleeve therein, said guide member being bolted to said sleeve.

5. The dispenser defined in claim 4 wherein within said sleeve a tubular seat is provided engageable by a valve plate biased by a spring against said seat and adapted to be pressed away from said seat by said tubular water-feed member upon its entry into said sleeve.

6. The dispenser defined in claim 5, further comprising a sleeve-shaped guide element for said valve plate and means for axially bracing said sleeve-shaped element against a sealing ring of said seat and forming, in turn, an axial support against which said sliding lip seal is braced.

7. The dispenser defined in claim 1 wherein said dispenser housing is provided with a clamping device for releasably receiving said unit and simultaneously forming a support foot for said storage vessel.

8. The dispenser defined in claim 7 wherein said clamping device includes a socket extending in said one direction and receiving said mixer housing, and a detent extending from said storage vessel and elastically engaging in a recess in said dispenser housing.

9. The dispenser defined in claim 1, further comprising a swingable cover on said dispenser housing affording access to said compartment.

* * * * *